US006109893A

United States Patent [19]

Gliniecki et al.

[11] Patent Number: 6,109,893

[45] Date of Patent: Aug. 29, 2000

[54] ELECTRIC FUEL PUMP WITH GROOVED COMMUTATOR FACE

[75] Inventors: Gary U. Gliniecki, Ruth; Gerald A. Hill, Cass City, both of Mich.

[73] Assignee: Walbro Corporation, Cass City, Mich.

[21] Appl. No.: 09/168,537

[22] Filed: Oct. 8, 1998

[51] Int. Cl.[7] ..... F27B 14/00

[52] U.S. Cl. ..... 417/423.7; 417/423.3; 310/236

[58] Field of Search ..... 417/244, 423.12, 417/423.7, 423.3; 415/55.3, 55.4; 310/237, 236, 233; 123/497; 29/597

[56] References Cited

U.S. PATENT DOCUMENTS

| | | | |
|---|---|---|---|
| 4,596,519 | 6/1986 | Tuckey | 418/15 |
| 4,718,827 | 1/1988 | Sutton et al. | 417/244 |
| 4,948,346 | 8/1990 | Tuckey | 417/312 |
| 5,013,221 | 5/1991 | Tuckey | 417/365 |
| 5,040,954 | 8/1991 | Iwai | 417/423.12 |
| 5,248,223 | 9/1993 | Hill | 415/55.3 |
| 5,530,311 | 6/1996 | Ziegler | 310/237 |
| 5,582,510 | 12/1996 | Dobbler et al. | 417/423.7 |
| 5,762,481 | 6/1998 | Oi | 417/423.3 |
| 5,912,523 | 6/1999 | Ziegler et al. | 310/237 |
| 5,932,949 | 8/1999 | Ziegler et al. | 310/236 |
| 5,962,946 | 10/1999 | Kobman et al. | 310/233 |
| 5,996,210 | 12/1999 | Konig | 29/597 |

*Primary Examiner*—Teresa Walberg
*Assistant Examiner*—Leonid Fastovsky
*Attorney, Agent, or Firm*—Reising, Ethington, Barnes, Kisselle, Learman & McCulloch, P.C.

[57] ABSTRACT

An electric fuel pump module includes a fuel pump driven by an electric motor. The motor has an armature provided with a commutator having a flat face. Brushes engage the flat face of the commutator to supply current to the armature. A groove in the flat face of the commutator provides relief preventing fuel from becoming trapped between the brush and the commutator face. The groove extends in a circular loop around the axis of rotation of the armature and may be centered on or laterally offset from the axis of rotation.

10 Claims, 1 Drawing Sheet

ELECTRIC FUEL PUMP WITH GROOVED COMMUTATOR FACE

FIELD OF THE INVENTION

This invention relates generally to electric fuel pumps, and more particularly to a commutator for and electric fuel pump armature.

BACKGROUND OF THE INVENTION

One of the problems associated with the use of a fuel pump with a commutator-type motor submerged in diesel or other forms of light oil is skating of the commutator brushes over the surface of the commutator. Fluid forms a film over the face of the commutator and becomes trapped between the brush and the commutator face as the commutator rotates. The fluid film elevates the brush away from the commutator face and the result is heavy arcing. Arcing results in increased brush wear.

SUMMARY OF THE INVENTION

One solution of this problem is to cut a narrow groove in the commutator face. This groove accomplishes two objectives, namely, it effectively raises the spring rate per unit area of the brush and secondly, the groove provides a path for fluid to escape under the brush, thereby reducing the tendency of the brush to skate.

The groove preferably is formed in a closed loop around the center of the axis of rotation of the commutator. The groove may be circular and it may be centered on the axis of commutator rotation. However, it is preferred to displace the circular groove slightly off center to the axis of armature rotation. When the circular groove is centered on the axis of rotation, the brush tends to develop a tab where the brush rides over the groove and hence is subjected to less wear. By offsetting the circular groove or using an elliptical groove, this tendency of the brush to form a tab at one point is eliminated. Preferably, the groove is offset sufficiently so that the entire brush surface rides across the groove at least once each revolution.

One object of this invention is to provide a commutator for the electric motor of a fuel pump having the foregoing features and capabilities.

Another object is to provide a commutator for the electric motor of a fuel pump which is of simple design, is inexpensive and economical to manufacture and assemble, is rugged and durable, reduces brush wear in use and in service has a long useful life.

BRIEF DESCRIPTION OF THE DRAWINGS

These and other objects features and advantages of the invention will become more apparent as the following description proceeds, especially when considered with the accompanying drawings wherein.

DETAILED DESCRIPTION OF THE PREFERRED EMBODIMENT

Figure 1:
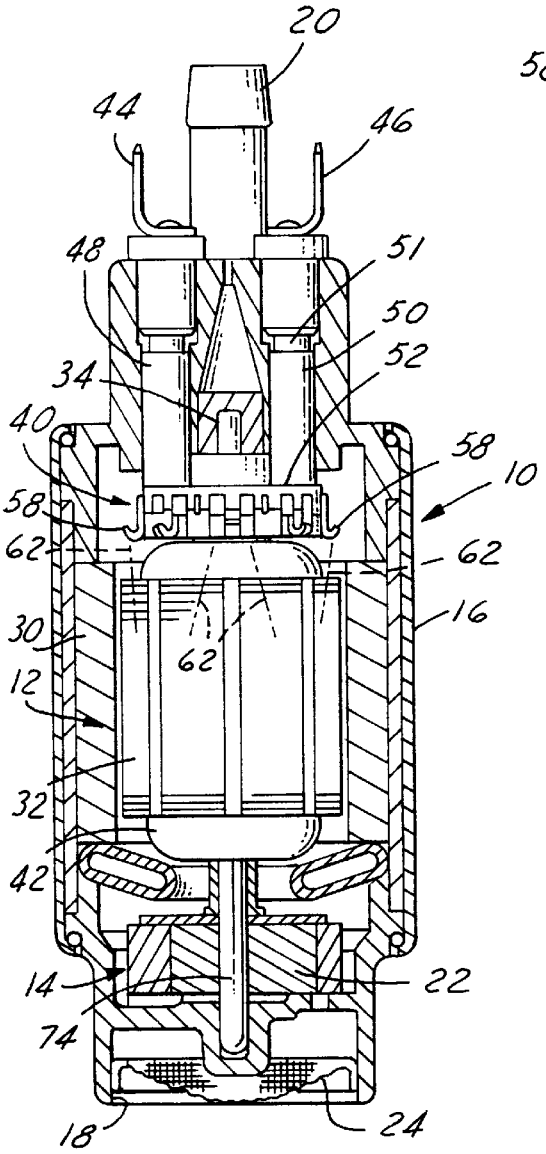
FIG. 1 is a longitudinal sectional view of a fuel pump module having a fuel pump including a commutator embodying this invention.
Figure 2:
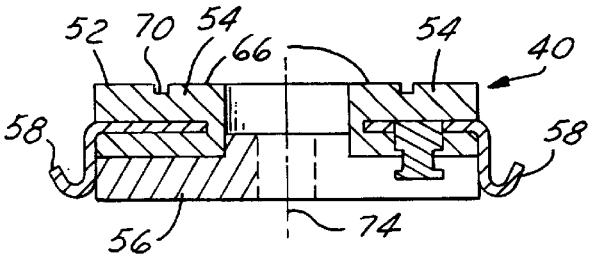
FIG. 2 is a sectional view of the commutator shown in FIG. 1.

Referring now more particularly to the drawings, an electric fuel pump module 10 for an automotive vehicle is typically mounted in a fuel tank. The module 10 has an electric motor 12 for driving a fuel pump 14 mounted in a housing 16 between a fuel inlet 18 and a fuel outlet 20. The pump 14 has a gear and rotor assembly 22 which draws fuel into the inlet through an inlet filter 24 and discharges the fuel into the housing 16 and through the outlet 20.

The motor 12 includes a permanent magnet stator 30 secured to the inner wall of the housing 16 and surrounding an armature 32. The armature 32 is mounted for axial rotation on a shaft 34 and has a flat commutator 40 secured to one end thereof. To energize the motor, current is supplied to coils 42 on the armature 32 through terminals 44 and 46 electrically connected to brushes 48 and 50 yieldably biased by springs 51 into engagement with a flat end face 52 of the commutator.

The commutator 40 has a circular array of individual sintered carbon segments 54 each of which is mounted on a base 56 and has embedded therein a copper conductor 58. Each conductor 58 is electrically connected to a coil 42 of the armature by an electrical conductor wire 62.

The carbon segments 54 are generally wedge-shaped and separated from one another by radial spaces 64. The surface or face 66 of the carbon segments are co-planar and define the flat commutator face 52 which lies in a plane perpendicular to the axis of rotation of the armature.

Formed in the surfaces 66 of the carbon segments are arcuate groove segments 70 which together form a groove 72 that extends in a loop around the axis or center 74 of rotation of the armature 32 and hence of the commutator. This groove 72 is preferably circular and closed except for the spaces 64 between carbon segments and may be concentric with the axis of rotation. The groove 72 is preferably 0.5 to 1 millimeter is width. The groove 72 forms a relief in the flat commutator end face 52 contacted by the brushes 48 and 50 so that fuel forming a film on the commutator face has a means of escape, allowing the brushes to contact the end face without skating and without arcing.

Figure 3:
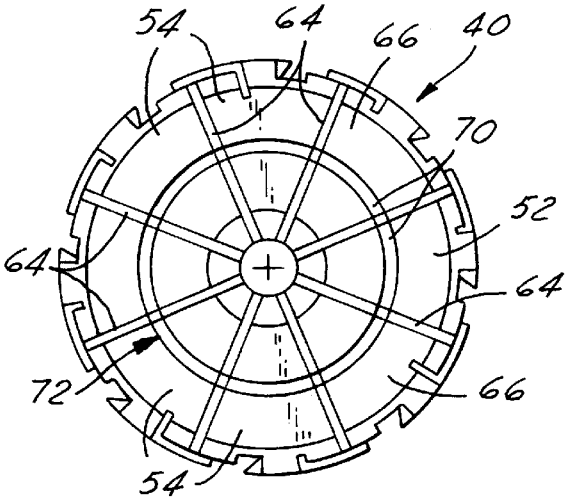
FIG. 3 is an end view of the commutator.
Figure 4:
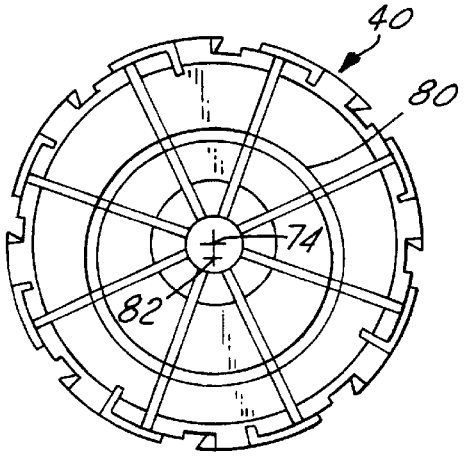
FIG. 4 is a view similar to FIG. 3, but showing a commutator of modified construction.

FIG. 4 shows a modified form of groove in the end face, the groove 80 there shown being circular but with its center 82 offset from the axis or center of rotation 74 of the commutator. By offsetting the groove 80, the relief provided does not continuously pass under the same point in the width of the brushes as the commutator rotates, but rather shifts transversely laterally across the brush end face to distribute the wear on the brush face and to reduce, if not altogether eliminate, the tendency of the brush face when wearing away in use to form a tab or projection of unworn material at the groove as might be the case in the FIG. 3 construction.

Preferably the offset in the location of the center of the groove 80 is sufficient to cause the groove to move laterally inwardly and outwardly across the full extent of the end face of the brushes.

While there has been illustrated a groove 72 or 80 of circular configuration, the groove may be oval or elliptical for some applications, if desired.

What is claimed is:

1. In an electric fuel pump module which includes a fuel pump within an elongated housing between a fuel inlet and a fuel outlet, an electric motor in said housing for driving the fuel pump, said motor including an armature mounted for axial rotation, a commutator having a flat end face and mounted on said armature for rotation therewith, means for supplying electric current to the armature including brushes carried by said housing, said brushes engaging the flat end face of said commutator, and a groove in the flat end face of said commutator positioned such that the brushes ride over the groove, said groove providing relief preventing fuel from becoming trapped between said brushes and the flat end face of said commutator.

2. In an electric fuel pump module as in claim 1, wherein said flat face of said commutator is perpendicular to the axis of rotation of the armature, and said groove extends in a loop around said axis of rotation.

3. In an electric fuel pump module as in claim 2, wherein said groove is circular and is concentric with said axis of rotation.

4. In an electric fuel pump module as in claim 3, wherein said groove is 0.5 to 1 millimeter in width.

5. In an electric fuel pump module as in claim 4, wherein said face of said commutator is composed of co-planar surfaces of a plurality of carbon segments in a circular array, said carbon segments being generally wedge-shaped and separated from one another by radial spaces therebetween.

6. In an electric fuel pump module as in claim 2, wherein said groove is circular and has a center which is offset from said axis of rotation.

7. In an electric fuel pump module as in claim 6, wherein said groove is 0.5 to 1 millimeter in width.

8. In an electric fuel pump module as in claim 7, wherein said face of said commutator is composed of co-planar surfaces of a plurality of carbon segments in a circular array, said carbon segments being generally wedge-shaped and separated from one another by radial spaces therebetween.

9. In an electric fuel pump module as in claim 2 wherein said groove is elliptical.

10. In an electric fuel pump module as in claim 2 wherein said groove is oval.

* * * * *